US008196769B2

(12) United States Patent
Ross

(10) Patent No.: US 8,196,769 B2
(45) Date of Patent: Jun. 12, 2012

(54) CONTAINER

(75) Inventor: Peter Ross, Middlesex (GB)

(73) Assignee: CP Cases Limited, Isleworth (GB)

( * ) Notice: Subject to any disclaimer, the term of this patent is extended or adjusted under 35 U.S.C. 154(b) by 105 days.

(21) Appl. No.: 12/852,396

(22) Filed: Aug. 6, 2010

(65) Prior Publication Data

US 2011/0042376 A1 Feb. 24, 2011

(30) Foreign Application Priority Data

Aug. 20, 2009 (GB) ..... 0914635.8

(51) Int. Cl.
*B65D 53/00* (2006.01)

(52) U.S. Cl. ..... 220/378

(58) Field of Classification Search ..... 220/232, 220/378, 619, 620, 4.02, 3.8, 3.94, 4.21
See application file for complete search history.

(56) References Cited

U.S. PATENT DOCUMENTS

| | | | | |
|---|---|---|---|---|
| 956,908 | A * | 5/1910 | Trachte | 220/622 |
| 1,695,563 | A * | 12/1928 | Stollberg | 220/619 |
| 3,055,529 | A * | 9/1962 | Cameron et al. | 220/4.07 |
| 3,599,826 | A * | 8/1971 | Rocher | 220/324 |
| 4,131,980 | A * | 1/1979 | Zinnbauer | 29/463 |
| 4,742,932 | A * | 5/1988 | Pedragosa | 220/619 |
| 7,648,041 | B2 * | 1/2010 | Ueda et al. | 220/378 |
| 2006/0186127 | A1 * | 8/2006 | Rajesh et al. | 220/619 |

FOREIGN PATENT DOCUMENTS

| | | |
|---|---|---|
| EP | 0 281 543 A2 | 9/1988 |
| FR | 2 604 976 A1 | 4/1988 |
| UK | 2 437 513 A | 10/2007 |

OTHER PUBLICATIONS

Search Report dated Nov. 26, 2009 for priority application No. GB0914635.8.

* cited by examiner

*Primary Examiner* — David Fidei
(74) *Attorney, Agent, or Firm* — Christie, Parker & Hale, LLP

(57) ABSTRACT

A container body 1 has a rim profile formed by folding sheet metal material. The profile defines at least two separate zones 14, 15 which are completely enclosed by the folded material and two runs of the material 5, 10 meet at the junction 16 between the two zones 14, 15 and are welded to one another at that junction. A lid 2 also has a rim profile folded from sheet material.

5 Claims, 1 Drawing Sheet

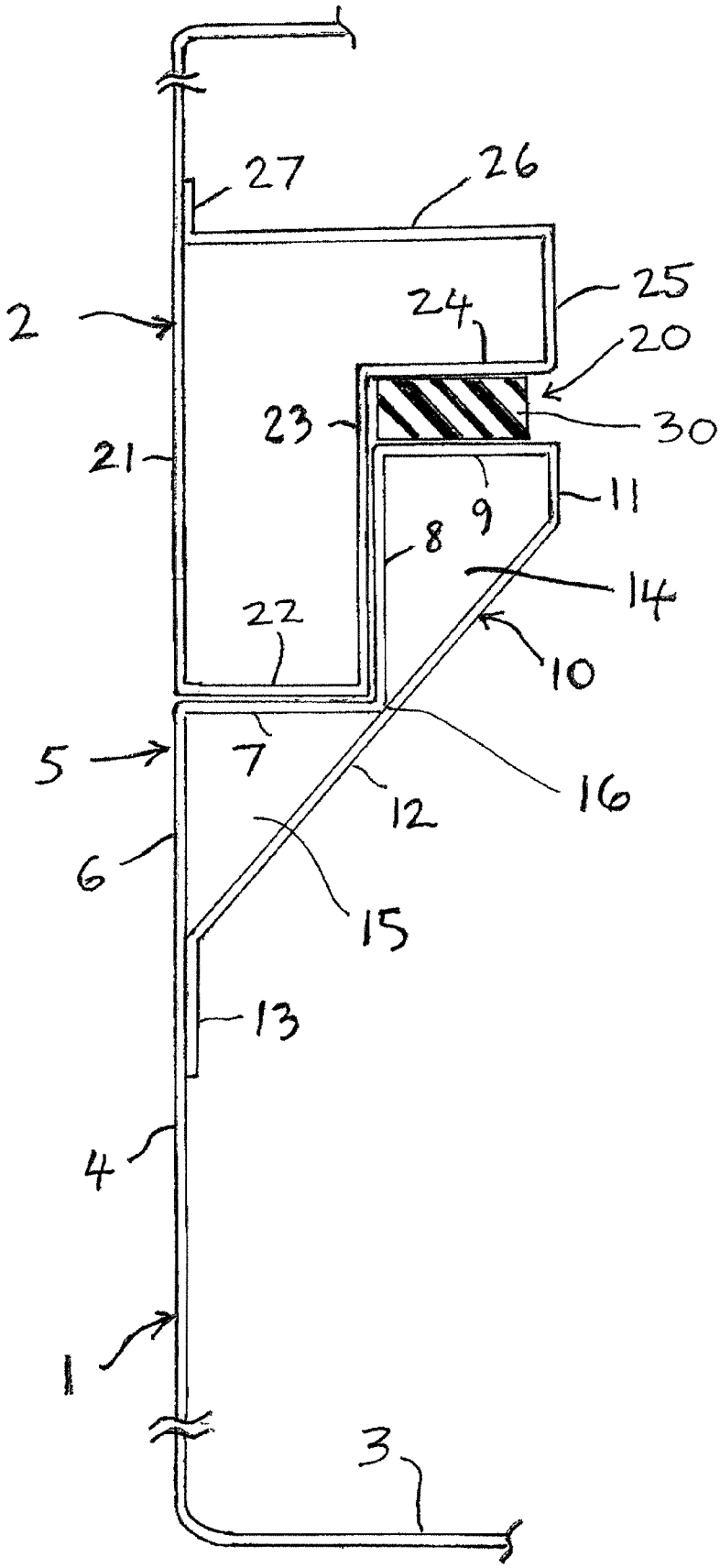
27
26
25
2
24
20
23
30
21
9
11
8
14
22
10
5
7
16
12
6
15
13
4
1
3

CONTAINER

CROSS-REFERENCE TO RELATED APPLICATION

This application claims priority to and the benefit of British Patent Application No. GB 0914635.8, filed on Aug. 20, 2009, the entire content of which is incorporated herein by reference.

BACKGROUND

This invention relates to containers. In particular, it relates to containers for the transportation and storage of sensitive equipment such as electrical, electronic or communications and computer equipment.

Transportation and storage cases and "racks" for sensitive equipment or material are well known. Generally, such containers comprise a body and one or more lids. Interengagement is provided between the body and lid by providing a rim profile extending around the entire periphery of the body and a mating or nesting rim profile extending around the entire periphery of the lid.

The body preferably comprises a box with four upstanding walls, the box comprising an opening at one or two ends, wherein the open end(s) is closed using a lid.

A container of this type made from plastic material is shown in GB 2437513A.

Metal containers of this type are also known and in this case, the rims of the container bodies and lids may be made from extrusions which are welded, riveted or fastened in some other method to the walls of the container bodies and lids. Typically, these containers are made from aluminum.

SUMMARY

The invention relates to containers of this type made of metal, in particular aluminum, in which the rim profiles of the bodies and lids are folded from the sheet material forming the walls of the bodies and lids. The invention provides a container having a rim profile of this type which provides excellent beam strength to the rim of the container.

The invention provides a container body having a rim profile formed by folding sheet metal material; the profile defining at least two separate zones which are completely enclosed by the folded material and wherein two runs of the material meet at the junction between the two zones and are fixed to one another at that junction.

BRIEF DESCRIPTION OF THE DRAWINGS

Embodiments of the invention are described below with reference to the accompanying drawing in which:

FIG. 1 shows a partial sectional view through a sidewall of a container and lid therefore.

DETAILED DESCRIPTION

As discussed above, the container may be of the kind having a base and four upright sidewalls defining an upper opening for a lid. Equally, the container may have no base but be open at both ends, each of which is closed by a lid. Whilst, in the description and claims which follow, the sidewall of the container is referred to as vertical, it is to be understood that this orientation is adopted for the purposes of illustration and does not limit the use of the invention.

With reference to the drawing, the container consists of a body 1 and a lid 2. As shown, the body has a base 3 and a vertical sidewall or outer wall 4. The rim profile of the container is formed by making a total of six folds in the sheet aluminum material from which the container is formed. Starting from the upper part of the outer wall 4, the material is folded to form two inwardly directed steps and then folded back on itself to meet the inside of the outer wall. Over this path, the profile is formed by two runs of material. The first or outer run 5 comprises a first vertical section formed by the upper portion 6 of the outer wall 4; a first horizontal section 7 extending inwardly of the container from the upper end of the outer wall; a second vertical section 8 extending upwardly from the inner end of the first horizontal section 7; and a second horizontal section 9 extending inwardly of the container from the upper end of the second vertical section 8. The second or inner run of material 10 is generally folded back onto the first run 5 and extends downwardly from the inner end of second horizontal section 9 to the inside of the first vertical section 6 of the outer wall 4. As shown, the second run 10 comprises a first vertical section 11 extending vertically downwardly from the inner end of the horizontal section 9 of the first run; an inclined section 12 extending downwardly and outwardly from the lower end of the vertical section 11; and a second vertical section 13 extending vertically downwardly from the lower end of the inclined section 12 along the inside of the outer wall 4. The vertical section 13 is fixed to the outer wall 4 such as by welding or other fixing method.

The outer and inner runs of material 5, 10 define two separate zones 14, 15 which are completely enclosed by the folded material. The two runs also meet at the junction 16 between the two zones 14, 15 and are fixed to one another at that junction such as by welding, e.g. by spot welding at intervals along the length of the junction 16. The two zones 14 and 15 are substantially triangular and provide great strength to the rim profile. It has been found that fixing the two runs together at the junction 16 greatly increases the strength of the profile.

The lid 2 also has a rim profile folded from the sheet material of its walls. The lid rim profile nests with the container body rim profile to form a secure interconnection between the container body and the lid. The lid profile comprises sections 21, 22, 23, 24, 25, 26 and 27. The vertical section 27 is fixed to the outer wall 21 of the lid 2 such as by welding or other fixing method As can be seen from the drawing, a space 20 is provided between the two profiles when nested together for the location of a resilient sealing member 30 which forms a watertight seal between the container body and the lid when the lid is closed and drawn tightly against the body by one or more latches (not shown). The sealing member 30 is attached to the lid 2 and the rim of the lid 2 provides protection to the sealing member 30 when the lid is detached from the body 1.

If desired, the horizontal return section 26 of the lid profile could be inclined downwardly and inwardly so that it meets the junction of sections 23, 24 and is fixed to them, such as by welding. By this means, the rim profile of the lid can be provided with two enclosed zones in the same manner as the rim profile of the container body.

Since it is not possible to form a folded rim profile extending completely around the container body and lid, corner pieces which are separately fabricated are welded into the container body and lid to provide a continuous uninterrupted profile, giving the complete rim section strength against deformation and going out of square.

It should be understood that use of the terms "vertical" and "horizontal" herein should not be taken to imply that the features so described must be strictly vertical or horizontal. For example, the section 8 of the container rim profile may be slightly inclined upwardly and inwardly to provide a lead in for location of the lid.

What is claimed is:

1. A container body having a rim profile formed by folding sheet metal material; the profile defining at least two separate zones which are completely enclosed by the folded material and wherein two runs of the material meet at the junction between the two zones and are fixed to one another at that junction wherein the first run of material comprises:

a first vertical section formed by an outer wall of the container body, a first horizontal section extending inwardly of the container from the upper end of the first vertical section;

a second substantially vertical section extending upwardly from the inner end of the first horizontal section; and a second horizontal section extending inwardly of the container from the upper end of the second vertical section;

wherein the second run of material extends downwardly from the inner end of the second horizontal section to the inside of the first vertical section;

and wherein the second run meets the first run at the junction between the first horizontal section and the second vertical section of the first run.

2. A container body as claimed in claim 1, wherein the second run comprises:

a first vertical section extending vertically downwardly from the inner end of the second horizontal section of the first run; an inclined section extending downwardly and outwardly from the lower end of the first vertical section to the inside of the first vertical section of the first run;

and a second vertical section extending vertically downwardly from the lower end of the inclined section along the inside of the first vertical section of the first run and being attached thereto.

3. A container body as claimed in claim 1, wherein the two runs of the material are welded together at the junction between the two zones.

4. A container comprising a container body as claimed in claim 1 and further comprising a lid having a rim profile folded from sheet metal material which nests with the container body rim profile to form a secure interconnection between the container body and the lid.

5. A container as claimed in claim 4, wherein a space is provided between the two profiles when nested together and wherein a resilient sealing member is located in the space for forming a seal between the body and the lid when the lid is closed.

* * * * *